US006175192B1

(12) United States Patent
Moon

(10) Patent No.: US 6,175,192 B1
(45) Date of Patent: Jan. 16, 2001

(54) MULTI-STEP TYPE ENERGY RECOVERING APPARATUS AND METHOD

(75) Inventor: Seong Hak Moon, Kyunggi-do (KR)

(73) Assignee: LG Electronics Inc., Seoul (KR)

( * ) Notice: Under 35 U.S.C. 154(b), the term of this patent shall be extended for 0 days.

(21) Appl. No.: 09/358,767

(22) Filed: Jul. 22, 1999

(30) Foreign Application Priority Data

Jul. 27, 1998 (KR) ..... 98-30228

(51) Int. Cl.[7] ..... G09G 3/10

(52) U.S. Cl. ..... 315/169.3; 315/169.4; 315/169.2

(58) Field of Search ..... 315/169.4, 169.3, 315/209 R, 169.2, 169.1

(56) References Cited

U.S. PATENT DOCUMENTS

| | | | | |
|---|---|---|---|---|
| 4,772,884 | * | 9/1988 | Weber et al. | 340/88 |
| 4,866,349 | * | 9/1989 | Weber et al. | 315/169.4 |
| 5,081,400 | * | 1/1992 | Weber et al. | 315/169.4 |
| 5,525,868 | * | 6/1996 | Browning | 315/169.3 |
| 5,642,018 | * | 6/1997 | Marcotte | 315/169.4 |
| 5,943,030 | * | 8/1999 | Minamibayashi | 345/60 |

* cited by examiner

*Primary Examiner*—Don Wong
*Assistant Examiner*—Trinh Vo Dinh
(74) *Attorney, Agent, or Firm*—Fleshner & Kim, LLP

(57) ABSTRACT

An energy recovering apparatus and method that is capable of reducing a power consumed during a sustaining discharge. In the apparatus and method, after an electric charge is charged in a current charging device to supply a display panel with a current, an external voltage is applied to the display panel to cause the sustaining discharge.

10 Claims, 10 Drawing Sheets

MULTI-STEP TYPE ENERGY RECOVERING APPARATUS AND METHOD

BACKGROUND OF THE INVENTION

1. Field of the Invention

This invention relates to an energy recovering technique, and more particularly to energy recovering apparatus and method that are capable of reducing a power consumed during sustaining discharge.

2. Description of the Related Art

A plasma display panel(PDP) is a device for displaying a picture by utilizing a gas discharge. The PDP provides a large-scale screen as well as an improved image quality owing to the recent development. The PDP is largely classified into a direct current(DC) driving system performing an opposite discharge and an alternating current(AC) driving system performing a surface discharge in accordance with its driving strategy. The AC driving system has been highlighted because it has a lower power consumption and a longer life time than the DC driving system. The PDP of AC driving system is intervened with a dielectric to apply an AC voltage and performs a discharge every its half period. The AC driving system is classified into a sub-frame system and a sub-field system. When 256 gray scales are expressed, the sub-field system makes a time division of one frame into 8 sub-fields. Each sub-field is time-divided into a reset interval for initializing the entire screen, an address interval for writing a data while scanning the entire screen in a line-sequence manner and a sustaining interval for sustaining a luminous state of cells into which the data is written. A time is assigned such that the reset interval and the address interval of each sub-field are same at each sub-field while the sustaining interval increases at a ratio of $2^n$(n=0, 1, 2, 3, 4, 5, 6 or 7) depending on a relative ration of the brightness. The gray scales proportional to the corresponding sustaining interval is implemented at each sub-field and the gray scales implemented at each sub-field are combined, thereby expressing 256 gray scales from one frame.

The sub-field system has a problem in that a power consumption is large at the time of charging or discharging the PDP in the sustaining interval. In the PDP of AC driving system, its driving circuitry includes an energy recovering circuit for recovering a voltage discharged from the panel again to charge the panel.

Referring to FIG. 1, there is an energy recovering apparatus that includes a scanning/sustaining electrode unit driving cell 10, hereinafter referred to as "Y electrode unit driving cell", connected to a Y electrode 1, and a common electrode unit driving cell 20, hereinafter referred to as "Z electrode unit driving cell", connected to a Z electrode 2. The Y electrode 1 and the Z electrode 2 are connected to a panel capacitor Cp. The panel capacitor Cp equivalently represents an electrostatic capacity formed between the Y electrode 1 and the Z electrode 2. The Y electrode 1 and the Z electrode 2 are discharged by a sustaining pulse applied to the Y electrode unit driving cell 10 and the Z electrode unit driving cell 20. The Y electrode unit driving cell 10 includes an external capacitor Cex1 connected to a ground terminal GND, first and third switches S1 and S3 connected, in parallel, to the external capacitor Cex1, second and fourth switches S2 and S4 connected, in series, between a sustaining voltage supply Vs and the ground terminal GND, and an inductor L1 connected between a first node n1 and a second node n2. The Z electrode unit driving cell 20 has the same configuration as the Y electrode unit driving cell 10 and is connected to the panel capacitor Cp in such a manner to be symmetrical to the Y electrode unit driving cell 10. Specifically, the Z electrode unit driving cell 20 includes an external capacitor Cex2 connected to a ground terminal GND, fifth and seventh switches S5 and S7 connected, in parallel, to the external capacitor Cex2, sixth and eighth switches S6 and S8 connected, in series, between a sustaining voltage supply Vs and the ground terminal GND, and an inductor L2 connected between a third node n3 and a fourth node n4. Diodes D1, D2, D3 and D4 connected to the first node n1 and the fourth node n4 are responsible for limiting a backward current.

The operation of the energy recovering apparatus will be explained on a basis of the Y electrode unit driving cell 10 with reference to FIG. 2. When the panel capacitor Cp is charged and discharged several times by the sustaining pulse, a voltage is charged in the external capacitors Cex1 and Cex2. In a t1 interval, the first switch S1 is closed. Then, a voltage charged in the external capacitor Cex1 is applied, via the first switch S1 and the inductor L1, to the inductor L1. Since the inductor L1 constructs a serial LC resonance circuit along with the panel capacitor Cp, the panel capacitor Cp begins to be discharged by a LC resonance waveform. At this time, the eighth switch S8 of the Z electrode unit driving cell 20 has been closed. In a t2 interval, the second switch S2 is closed at a resonant point of the LC resonance waveform. Then, since the sustaining voltage Vs is applied to the panel capacitor Cp, the panel capacitor Cp maintains a sustaining voltage level. A discharge is caused between the Y electrode 1 and the Z electrode 2 in a time interval when the panel capacitor Cp maintains a sustaining voltage level. In a t3 interval, the second switch S2 is opened and the third switch S3 is closed and thus the panel capacitor Cp begins to be discharged. At this time, a voltage charged in the panel capacitor Cp is applied, via the inductor L1 and the third switch S3, to the external capacitor Cex1 to charge the external capacitor Cex1. Next, the fourth switch S4 is closed. Then, a voltage of the panel capacitor Cp drops into a ground voltage. The Z electrode unit driving cell 20 charges and discharges a panel capacitor Cp alternately with the Y electrode unit driving cell 10.

As a result, the energy recovering apparatus recovers a voltage discharged from the panel capacitor Cp by utilizing the external capacitors Cex1 and Cex2 and applies it to the panel capacitor Cp, thereby reducing an inordinate power consumption during the sustaining discharge. Since an efficiency and the brightness of the PDP are basically influenced by a current, they has a limit as long as the panel capacitor Cp is charged by means of voltage sources such as external capacitors Cex1 and Cex2.

On the other hand, in the sub-frame driving system, an addressing interval of the entire screen is distributed partially every period of a sustaining pulse to continue the sustaining process without an interruption. In the sub-frame system, when it is intended to express the 256 gray scales, the entire screen is divided into 8 time regions T, T/2, T/4, T/8, T/16, T/32, T/64 and T/128 in the horizontal direction and a discharge weighting value is assigned to each time region in similarity to the sub-field system. Accordingly, at an optional time, 8 screen blocks with a different brightness level, that is, in a different sub-field state exist in the entire screen. 8 scanning lines selected in one sustaining pulse period repeats a process moved downward by one scanning line each time the sustaining pulse period is changed. In such a sub-frame driving system, the sustaining pulse includes a level of more than three steps such that it has a reference level of a writing pulse and a reference level of an erasing pulse every period. Since the energy recovering apparatus as shown in FIG. 1 is connected in cascade as many as the number of step so as to generate a sustaining pulse having a level of more than three steps, the configuration of the driving circuitry becomes complicated.

SUMMARY OF THE INVENTION

Accordingly, it is an object of the present invention to provide an energy recovering apparatus and method of multi-step type that is capable of reducing a power consumption during sustaining discharge.

Further object of the present invention is to provide an energy recovering apparatus and method that is capable of improving its efficiency and the brightness.

Still further object of the present invention is to provide an energy recovering apparatus and method of multi-step type that is suitable for an energy recovery on a multi-step driving waveform.

In order to achieve these and other objects of the invention, an energy recovering apparatus of multi-step type according to one aspect of the present invention includes a current charging device for supplying a display panel with a current; an external voltage source for applying an external voltage to the display panel; and switch means for switching a current path between the display panel and the current charging device in such a manner that a current charged in the current charging device is supplied to the display panel before the external voltage is applied to the display panel.

An energy recovering apparatus of multi-step type according to another aspect of the present invention includes at least two current charging devices for supplying a display panel with a current, said current charging devices having a different charge capacity; an external voltage source for applying an external voltage to the display panel; and switch means for selecting any one of the current charging devices in accordance with a panel load before the external voltage is applied to the display panel and for switching a current path between the display panel and the current charging device in such a manner that a current charged in the selected current charging device is supplied to the display panel.

An energy recovering method of multi-step type according to still another aspect of the present invention includes the steps of charging an electric charge into a current charging device; supplying a display panel with a current; and applying an external voltage to the display panel to cause a sustaining discharge.

An energy recovering method of multi-step type according to still another aspect of the present invention includes the steps of charging an electric charge into any one of a plurality of current charging devices in accordance with a panel load; supplying a display panel with a current charged in the current charging device; and applying an external voltage to the display panel to cause a sustaining discharge.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
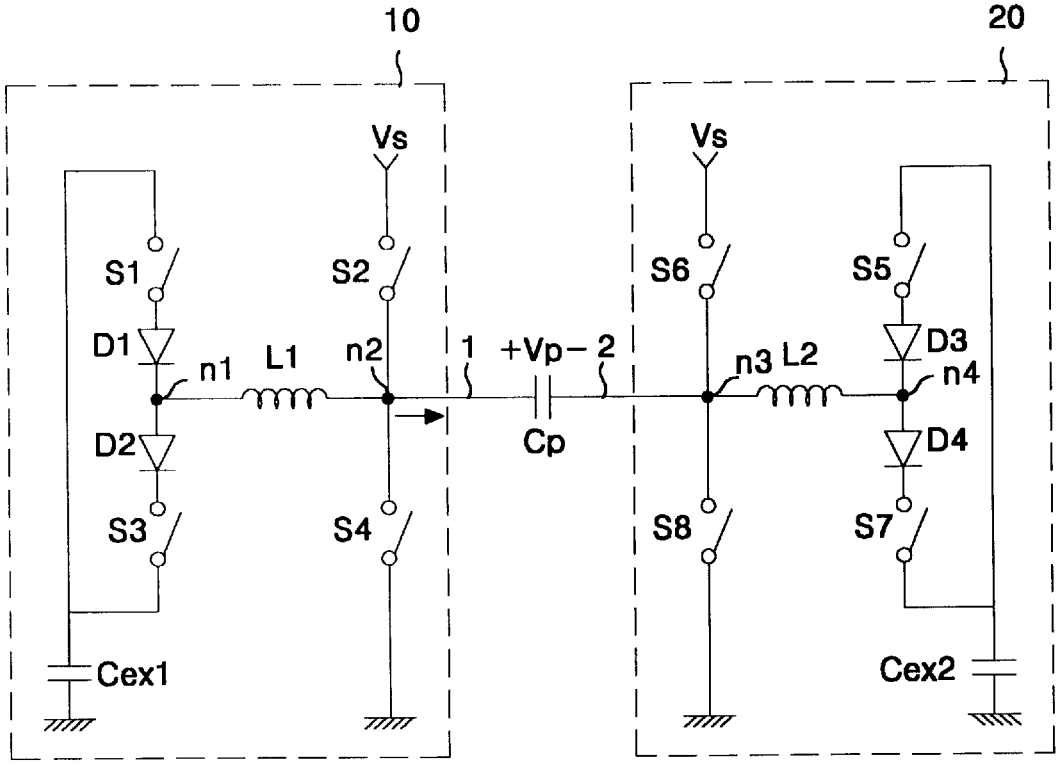
FIG. 1 RELATED ART
FIG. 1 is a circuit diagram of a conventional energy recovering apparatus.
Figure 2:
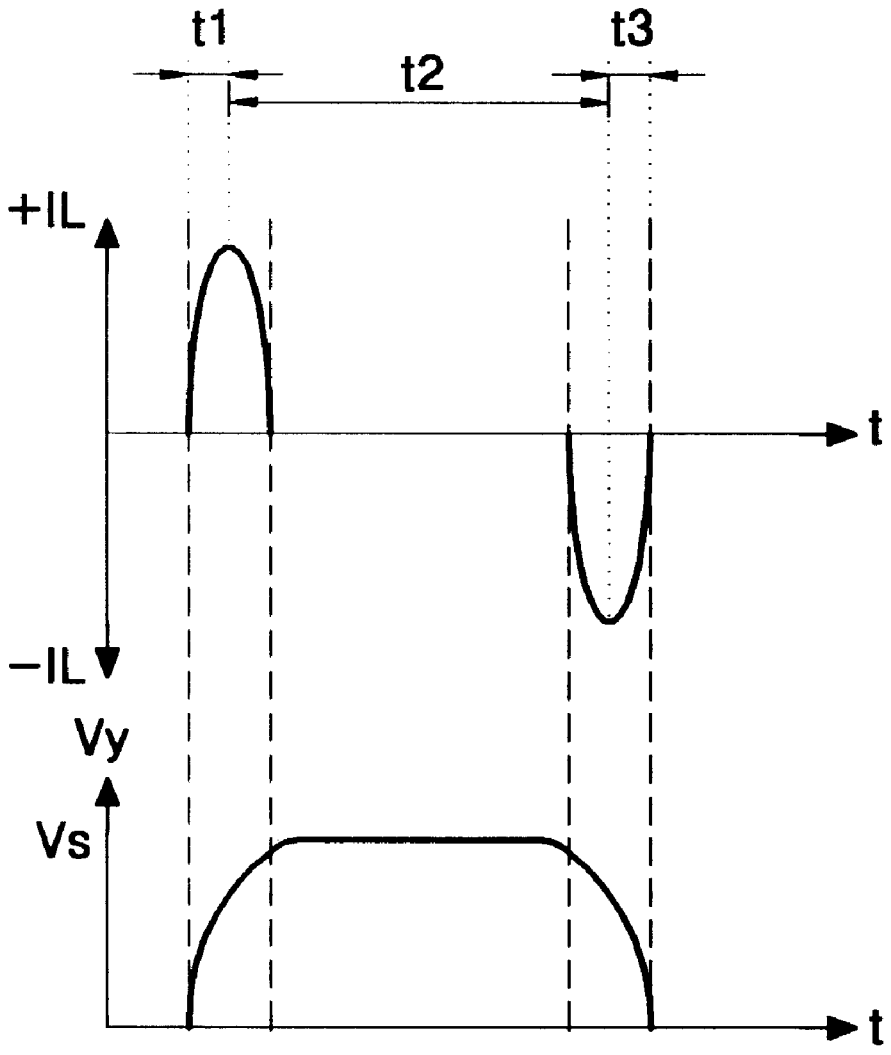
FIG. 2 RELATED ART
FIG. 2 is an output waveform diagram of the energy recovering apparatus shown in FIG. 1.
Figure 3:
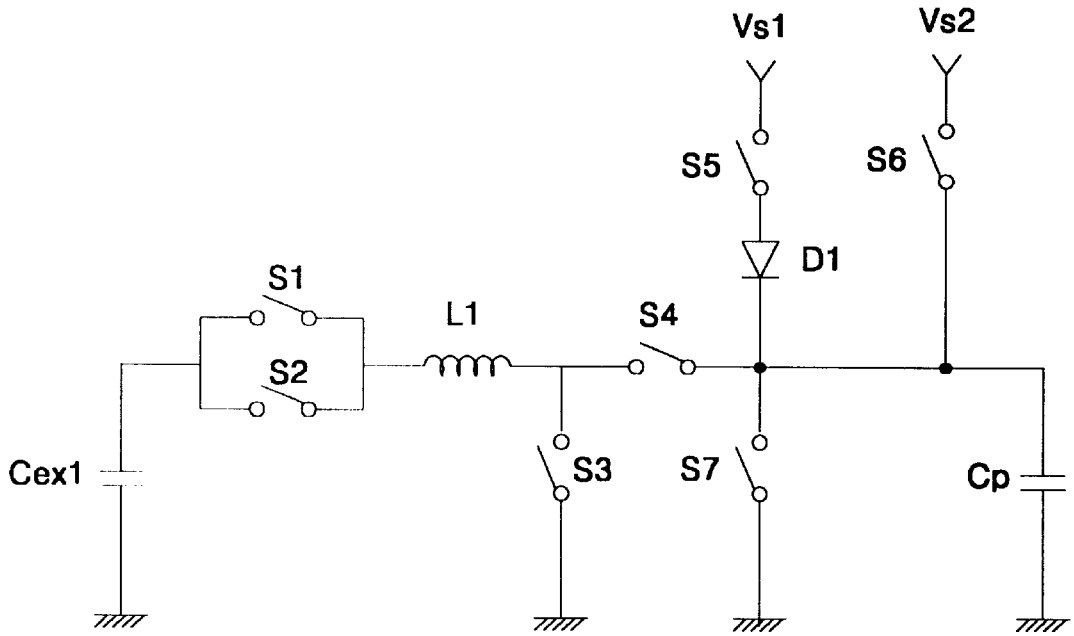
FIG. 3 is a circuit diagram of an energy recovering apparatus of multi-step type according to a first embodiment of the present invention.
Figure 4:
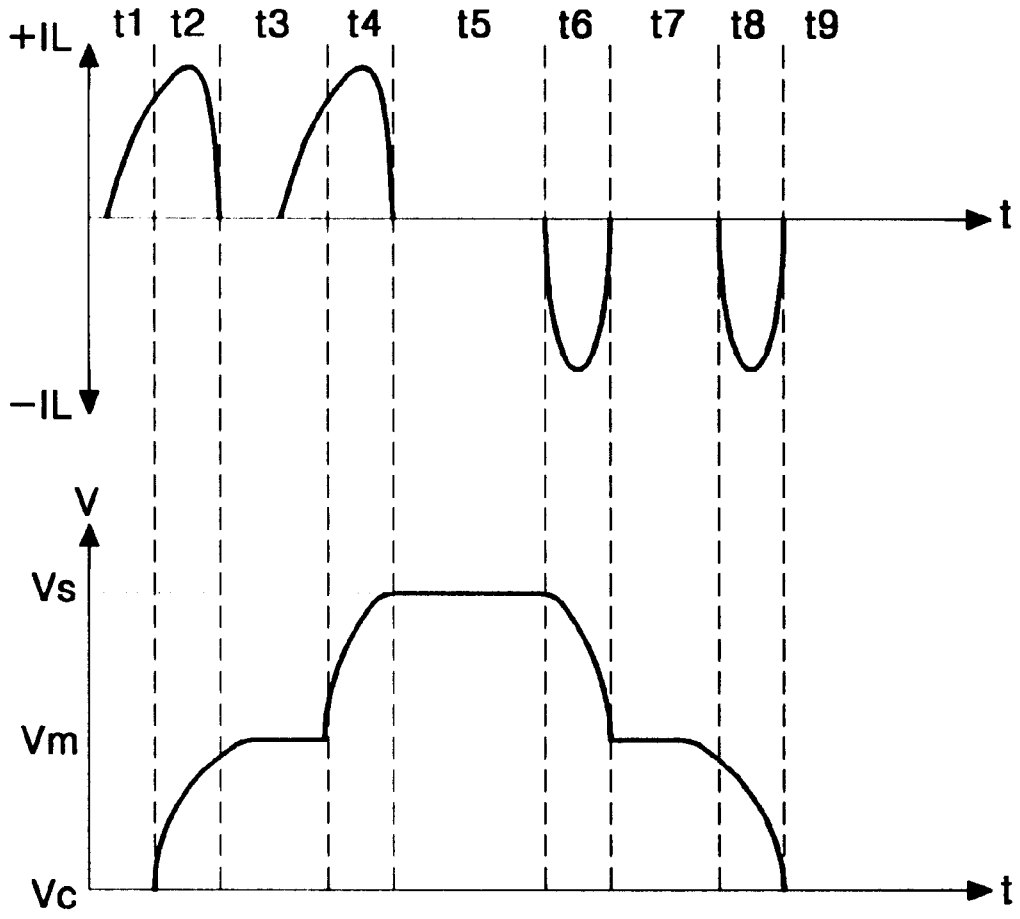
FIG. 4 is an output waveform diagram of the energy recovering apparatus shown in FIG. 3.

FIG. 3 is a circuit diagram showing the configuration of a multi-step type energy recovering apparatus according to a first embodiment of the present invention. FIG. 4 represents an output current IL of the inductor L1 in FIG. 3 and an output voltage Vc of the panel capacitor Cp in FIG. 3.

Referring to FIG. 3, the multi-step type energy recovering apparatus includes an inductor L1 connected to a panel capacitor Cp to apply a current charged before an external voltage is applied to the panel capacitor Cp. Further, the energy recovering apparatus includes an external capacitor Cex1 connected to the ground, first and second switches S1 and S2 connected, in parallel, between the external capacitor Cex1 and the inductor L1, third and fourth switches S3 and S4 connected, in parallel, to the inductor L1, fifth and seventh switches S5 and S7 connected, in parallel, to the switches S4, and a sixth switch S6 connected to the panel capacitor Cp. A first sustaining voltage V1 is applied to the fifth switch S5 while a second sustaining voltage V2 is applied to the sixth switch S6.

Referring now to FIG. 3 and FIG. 4, a three-step voltage is charged in the panel capacitor Cp from a t1 interval until a t5 interval. In the t1 interval, the first and third switches S1 and S3 are closed. Then, the inductor L1 is charged by an electric charge coupled from the external capacitor Cex1. In the t2 interval, the third switch S3 is opened while the fourth switch S4 is closed. Then, an electric charge charged in the inductor L1 charges the panel capacitor Cp into a middle level voltage Vm. Subsequently, in the t3 interval, the fifth switch S5 is closed. Then, a first sustaining voltage Vs1, which is an external voltage, is applied, via the fifth switch S5, to the panel capacitor Cp and hence the panel capacitor Cp maintains the middle level voltage Vm. Subsequently, the fourth switch S4 is opened while the first and third switches S1 and S3 are closed. Then, the inductor L1 is charged by an electric charge charged in the external capacitor Cex1. In the t4 interval, the third switch S3 is opened while the fourth switch S4 is closed. Then, an electric charge charged in the inductor L1 is applied to the panel capacitor Cp and hence the panel capacitor Cp is charged into a sustaining voltage Vs. In the t5 interval, the sixth switch S6 is closed. Then, a voltage level of the panel capacitor Cp remains at a level of the sustaining voltage Vs due to a second sustaining voltage Vs2. As described above, the inductor L1 charges an electric charge before an external voltage is applied to the panel, and it is responsible for applying the electric charge to the panel.

A discharge of the panel capacitor Cp will be described. First, in the t6 interval, if the second and fourth switches S2 and S4 are closed, then an electric charge is charged in the external capacitor Cex1. At this time, the panel capacitor Cp is discharged into the middle level voltage Vm. In the t7 interval, the fifth switch S5 is closed while the fourth switch S4 is opened. Then, the panel capacitor Cp maintains the middle level voltage Vm. In the t8 interval, the second and fourth switches S2 and S4 are closed. Then, the external capacitor Cex1 is charged by a voltage charged in the panel capacitor Cp. Subsequently, the seventh switch S7 is closed. At this time, a voltage of the panel capacitor is discharged into a ground potential to have 0V.

Figure 5:
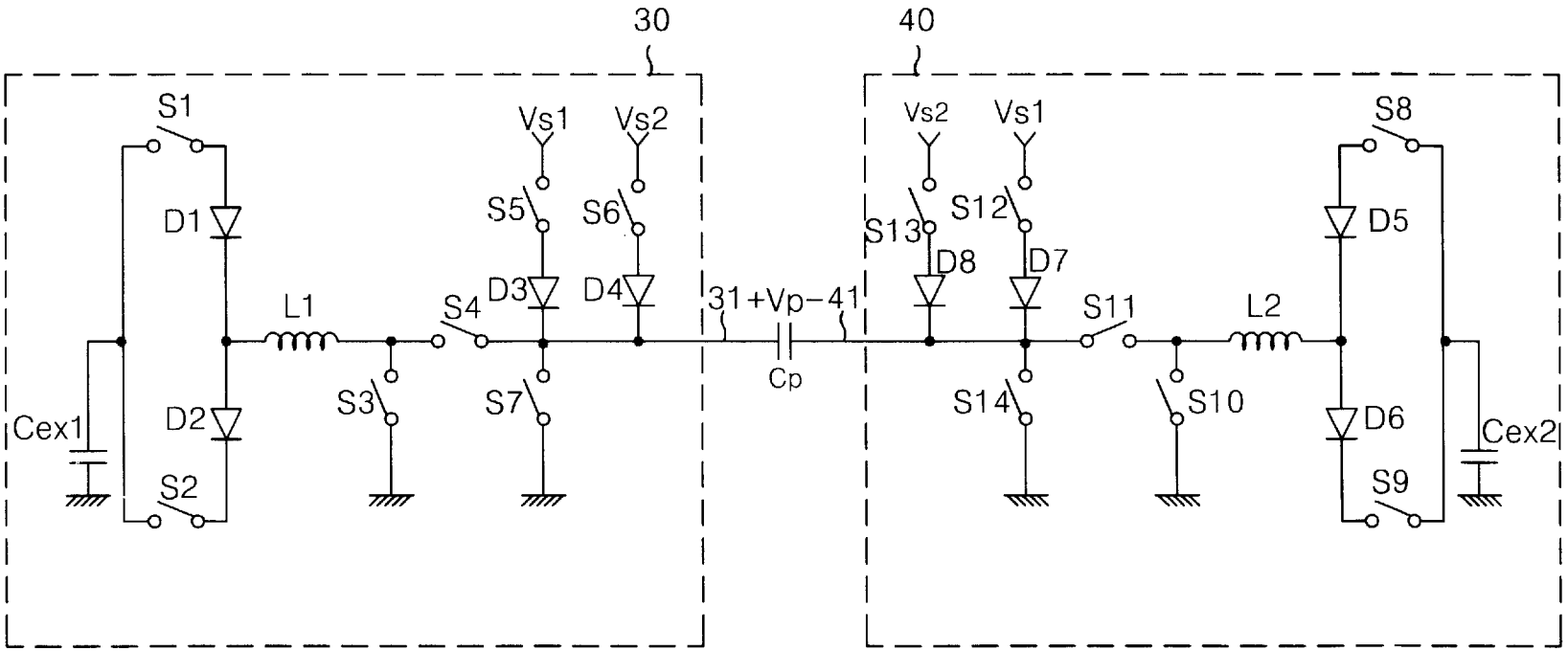
FIG. 5 is a circuit diagram of an energy recovering apparatus of multi-step type according to a second embodiment of the present invention.

Such an electrode unit driving cells are constructed symmetrically with respect to the panel capacitor Cp. Referring now to FIG. 5, the multi-step energy recovering apparatus includes a Y electrode unit driving cell 30 connected to a Y electrode 31, and a Z electrode unit driving cell 40 connected to a Z electrode 41. The Y electrode unit driving cell 30 is identical to the unit driving cell shown in FIG. 3, and the Z electrode unit driving cell 40 is constructed symmetrically to the Y electrode unit driving cell 30 on the basis of the panel capacitor Cp. Specifically, the Z electrode unit driving cell 40 includes eighth and ninth switches S8 and S9 connected, in parallel, to an external capacitor Cex2, an inductor L2 connected commonly to the eighth and ninth switches S8 and S9, tenth and eleventh switches S10 and S11 connected, in parallel, to the inductor L2, twelfth and fourteenth switches S12 and S14 connected, in parallel, to the eleventh switch S11, and a thirteenth switch S13 connected to the panel capacitor Cp. The twelfth switch S12 is connected to a first sustaining voltage supply Vs1 while the thirteenth switch S13 is connected to a second sustaining voltage supply Vs2.

The Y electrode unit driving cell 30 and the Z electrode unit driving cell 40 are alternately driven to charge and discharge the panel capacitor Cp. The operation of the Y electrode unit driving cell 30 and the Z electrode unit driving cell 40 will be described in conjunction with FIG. 5 and FIG. 6.

Figure 6:
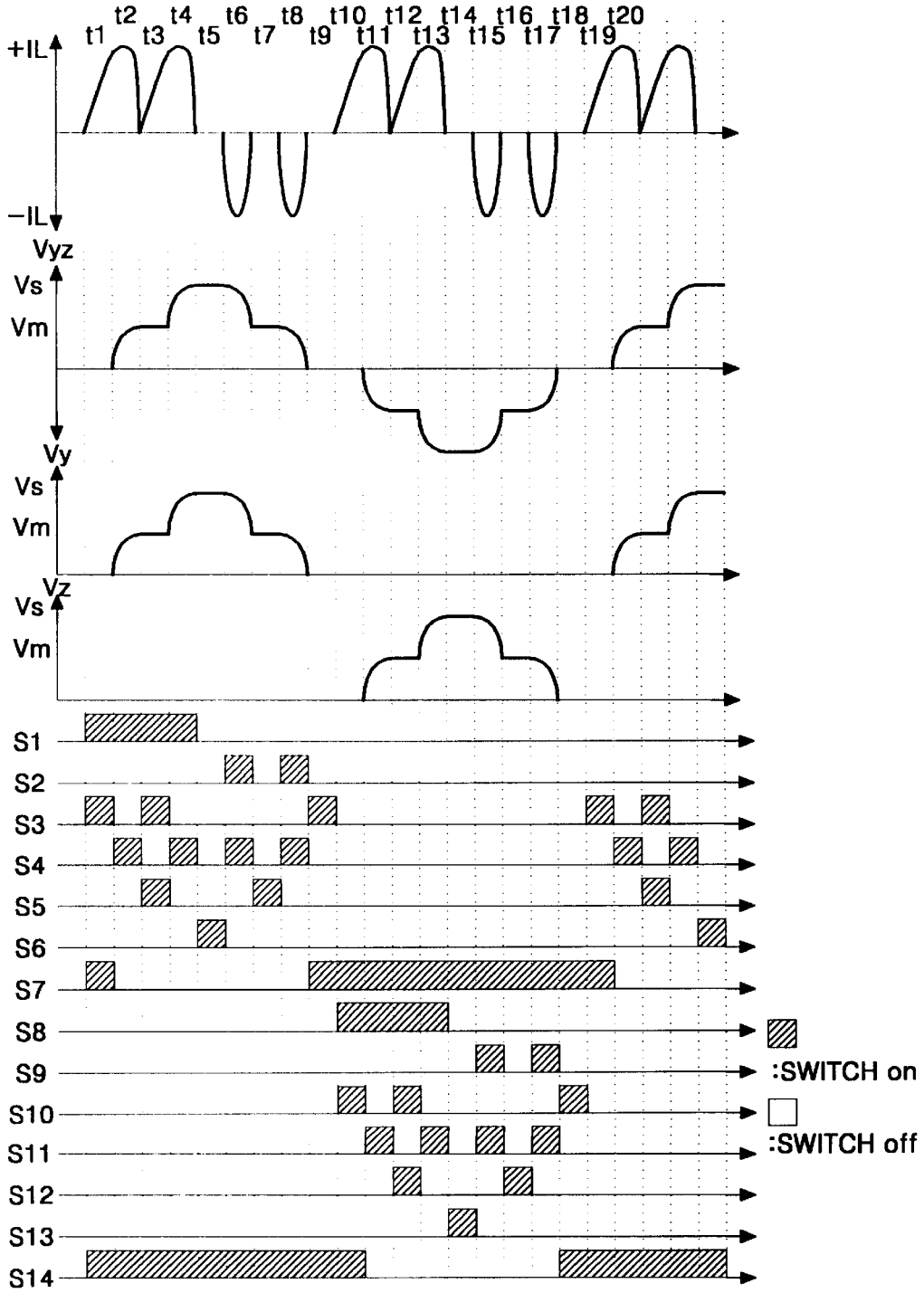
FIG. 6 is an output waveform diagram of the energy recovering apparatus shown in FIG. 5.

In FIG. 6, IL represents a current waveform charged and discharged in the first and second inductors L1 and L2, and Vy and Yz does voltage waveforms at the panel capacitor Cp charged in the panel capacitor Cp by the Y electrode unit driving cell 30 and the Z electrode unit driving cell 40, respectively. Vyz represents a voltage waveform at the panel capacitor Cp when the Y electrode unit driving cell 30 and the Z electrode unit driving cell 40 are driven alternately. In FIG. 6, "▨" represents a state in which a switch is closed, whereas "□" represents a state in which a switch is opened.

In a t1 interval, the switches S1, S3, S7 and S14 are closed. At this time, the first inductor L1 is charged by an electric charge applied from the first external capacitor Cex1. The first switch S1 maintains a closed state until a t4 interval while the fourteenth switch S14 maintains a closed state until a t10 interval. In a t2 interval, the third switch S3 is opened while the fourth switch S4 is closed. Then, an electric charge charged in the first inductor L1 is applied to the panel capacitor Cp. At this time, the panel capacitor Cp is charged a middle voltage Vm by an electric charge coupled from the first inductor L1. In the t3 interval, the third and fifth switches S3 and S5 are closed while the fourth switch S4 is opened. Then, a voltage level of the panel capacitor Cp maintains the middle voltage level by a first sustaining voltage Vs. At this time, since the first switch S1 maintains a closed state, the first inductor L1 is charged by an electric charge applied from the first external capacitor Cex1. In the t4 interval, the third and fifth switches S3 and S5 are opened while the fourth switch S4 is closed. Then, an electric charge charged in the first inductor L1 charges the panel capacitor Cp into a sustaining voltage Vs. In the t5 interval, the sixth switch S6 is closed while the fourth switch S4 is opened. Then, a voltage level of the panel capacitor Cp maintains the sustaining voltage Vs by a second sustaining voltage Vs2. As described above, in the t1 to t5 intervals, the panel capacitor Cp is charged in the three steps of ground voltage GND, middle voltage Vm and sustaining voltage Vs by the Y electrode unit driving cell 30.

In a t6 interval, the second and fourth switches S2 and S4 are closed while the sixth switch S6 is opened. Then, the panel capacitor Cp is discharged into the middle voltage Vm and, at the same time, charges the first external capacitor Cex1. In a t7 interval, the fifth switch S5 is closed while the second and fourth switches S2 and S4 are opened. Then, since the first sustaining voltage Vs1 is applied to the panel capacitor Cp, a voltage level of the panel capacitor Cp remains at the middle voltage Vm. In a t8 interval, the second and fourth switches S2 and S4 are closed while the fifth switch S5 are opened. Then, the panel capacitor Cp is discharged into the ground GND, and the first external capacitor Cex1 is charged by a voltage applied from the panel capacitor Cp. As described above, in the t6 to t8 intervals, the panel capacitor Cp is discharged into the three step of sustaining voltage Vs, middle voltage Vm and ground voltage GND by the Y electrode unit driving cell 30. In a t9 interval, the second and fourth switches S2 and S4 are opened while the third and seventh switches S3 and S7 are closed and hence the panel capacitor Cp maintains the ground potential. The seventh switch S7 maintains a closed state until the t19 interval.

The Z electrode unit driving cell 40 charges the panel capacitor Cp from the t10 interval until a t14 interval. In a t10 interval, the third switch S3 is opened while the eighth and tenth switches S8 and S10 are closed. At this time, the second inductor L2 is charged by an electric charge coupled from the second external capacitor Cex2. The eighth switch S8 maintains a closed state until a t13 interval. In a t11 interval, the tenth and fourteenth switches S10 and S14 are opened while the eleventh switch S11 is closed. Then, since an electric charge charged in the second inductor L2 is applied to the panel capacitor Cp, the panel capacitor Cp is charged into the middle voltage Vm. In a t12 interval, the tenth and twelfth switches S10 and S12 are closed while the eleventh switch S11 is opened. Then, since the panel capacitor Cp remains at the middle level voltage Vm, and the second inductor L2 is charged by an electric charge coupled from the second external capacitor Cex2. In a t13 interval, the tenth and twelfth switches S10 and S12 are opened while the eleventh switch S11 is closed. Then, since an electric charge charged in the first inductor L1 is applied to the panel capacitor Cp, the panel capacitor Cp is charged into the sustaining voltage Vs. In a t14 interval, the thirteenth switch S13 is closed while the eighth and eleventh switches S8 and S11 are opened. Then, since the second sustaining voltage Vs2 is applied to the panel capacitor Cp, a voltage level of the panel capacitor Cp maintains the sustaining voltage Vs. In a t15 interval, the ninth and eleventh switches S9 and S11 are closed while the thirteenth switch S13 is opened. Then, the panel capacitor Cp is discharged into the middle voltage Vm, and the second external capacitor Cex2 is charged by a discharge of the panel capacitor Cp. In a t16 interval, the twelfth switch S12 is closed while the ninth and eleventh switches S9 and S11 are opened. Then, a voltage level of the panel capacitor Cp maintains the middle voltage Vm by the first sustaining voltage Vs1. In a t17 interval, the ninth and eleventh switches S9 and S11 are closed while the twelfth switch S12 is opened. Then, the panel capacitor Cp is discharged into the ground potential GND, and the second external capacitor Cex2 is charged by a voltage applied from the panel capacitor Cp.

As described above, the multi-step type energy recovering apparatus charges an electric charge into the inductors L1 and L2 in advance, and applies low level external voltages Vs1 and Vs2 after charging the electric charge into the panel capacitor Cp.

Meanwhile, a load of the panel can become different depending on whether or not the panel has been discharged or on the brightness of a picture data. If the load of panel is different, then a rising time of the sustaining voltage vs becomes different. If a capacitance value of the panel capacitor Cp becomes different, then the sustaining voltage applied from the exterior goes amiss from a resonant point of a current waveform applied from the inductor. As a capacitance value of the panel capacitor Cp increases, a rising time of the sustaining voltage Vs is lengthened. On the other hand, as a capacitance of the panel capacitor Cp decreases, a rising time of the sustaining voltage Vs is shortened. As described above, if an applied time of the sustaining voltage Vs goes amiss from a resonant point applied from the inductor, a level of the sustaining voltage Vs required for a discharge rises and hence a power consumption increases to that extent.

Figure 7:
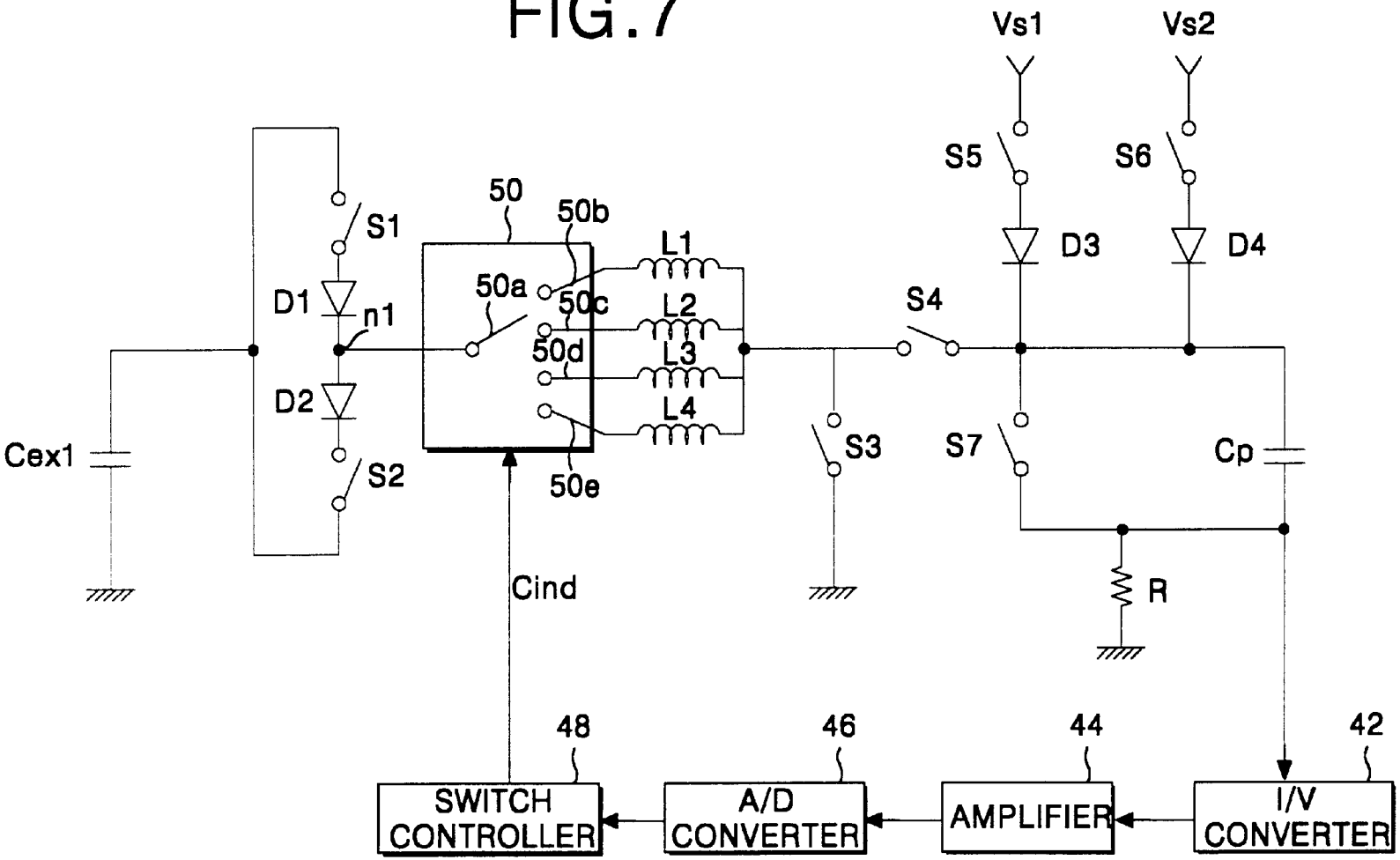
FIG. 7 is a circuit diagram of an energy recovering apparatus of multi-step type according to a third embodiment of the present invention.

Referring now to FIG. 7, the multi-step energy recovering apparatus includes a resistor R connected between the panel capacitor Cp and the ground terminal GND, first to fourth inductors L1 to L4 having a different inductance from each other, first and second switches S1 and S2 connected, in parallel, among the first to fourth inductors L1 to L4, a switch part connected among the switches S1 and S2 and the inductors L1 to L4, a current/voltage converter 42, hereinafter referred to as "I/V converter", an amplifier 44, an analog to digital converter 46, hereinafter referred to as "A/D converter", and a switch controller 48 connected, in series, between the resistor R and the switch part 50. Further, the multi-step type energy recovering apparatus includes third and fourth switches S3 and S4 connected, in parallel, between the first to fourth inductors L1 to L4, a seventh switch S7 connected between the fourth switch S4 and the resistor R, a fifth switch S5 connected between the first sustaining voltage supply Vs1 and the panel capacitor Cp, and a sixth switch S6 connected between the second sustaining voltage supply Vs2 and the panel capacitor Cp. Diodes D1 to D4 are responsible for limiting a backward current.

The inductors L1 to L4 have a different inductance value and are selectively connected to the external capacitor Cex1 by the switch part 50. The resistor R detects a load change according to the on/off of the panel or a load change according to the brightness change of a picture data into a current signal. The I/V converter 42 converts a current signal detected by the resistor R into a voltage signal. The amplifier 44 amplifies a voltage signal from the I/V converter 42 by its gain value and applies the same to the A/D converter 46. The A/D converter 46 converts a voltage signal from the amplifier 44 into a digital shape and applies the same to the switch controller 48. The switch controller 48 applies a switch control signal Cind having a logical value changing in accordance with a digital signal from the A/D converter 46 to the switch part 50 to thereby control the switch part 50. The switch part 50 selectively connects a reference terminal 50*a* to any one of the first to fourth selecting terminals 50*b* to 50*c* in accordance with a logical value of the switch control signal Cind applied from the switch controller 48. The energy recovering apparatus shown in FIG. 7 charges and discharges the panel capacitor Cp by the substantially identical driving waveform in FIG. 4 except that an inductor connected to the panel capacitor Cp depending on the panel load. When inductance values of the inductors L1 to L4 have a relationship of L1<L2<L3<L4, that is, when the first inductor L1 is set to the smallest inductance value and the fourth inductor L4 is set to the largest inductance value, any one of the inductors L1 to L4 is selected in accordance with the panel load as follows. If a low panel brightness is detected, that is, if a current applied to the panel is low, then the fourth inductor L4 or the third inductor L3 having a relatively large inductance value is connected to a first node n1. On the other hand, if a high panel brightness is detected, that is, if a current applied to the panel is high, then the first inductor L1 or the second inductor L2 having a relatively small inductance value is connected to a first node n1. A rising time of a current waveform applied from the inductor to the panel capacitor Cp becomes different depending on inductance values of the inductors L1 to L4. Accordingly, since the inductance value is controlled in accordance with the panel load, an applied time of the sustaining voltages Vs1 and Vs2 can be synchronized with a peak value of the inductor current waveform applied to the panel capacitor Cp.

Figure 8:
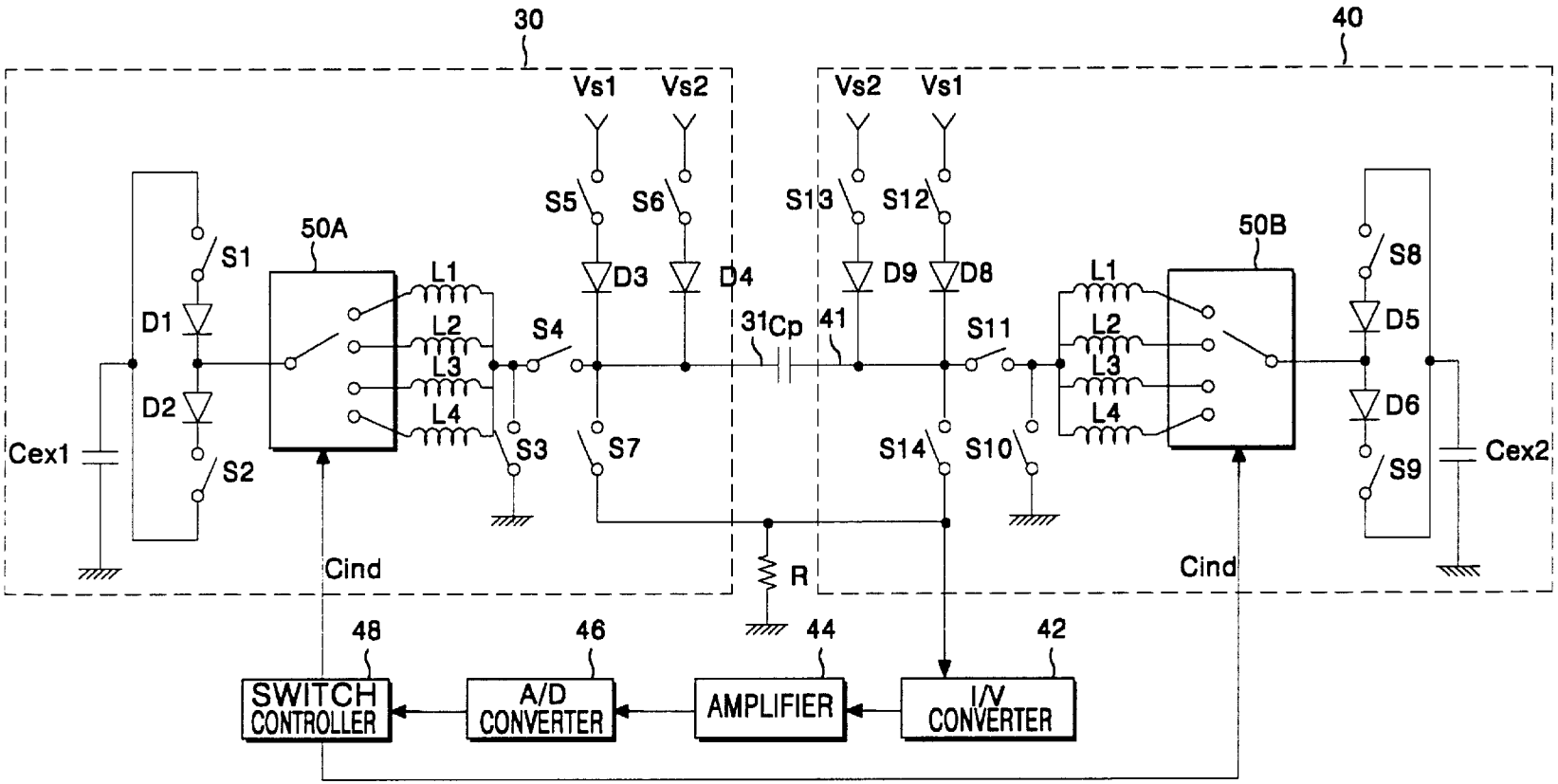
FIG. 8 is a circuit diagram of an energy recovering apparatus of multi-step type according to a fourth embodiment of the present invention.

FIG. 8 shows an embodiment to which a plurality of inductors and switch parts for controlling an inductance value in accordance with a panel load in the energy recovering apparatus shown in FIG. 5 are applied. Referring to FIG. 8, the multi-step energy recovering apparatus includes a Y electrode unit driving cell 30 connected to a Y electrode 31, and a Z electrode unit driving cell 40 connected to a Z electrode 41. The Y electrode unit driving cell 30 and the Z electrode unit driving cell 40 are connected symmetrically with respect to a panel capacitor Cp to charge and discharge the panel capacitor Cp alternately, thereby causing a sustaining discharge between the Y electrode 31 and the Z electrode 41. A resistor R for detecting a panel load, an I/V converter 42, an amplifier 44, A/D converter 46, a switch controller 48 and switch parts 50A and 50B have the same function as those shown in FIG. 7. Accordingly, each switch part 50A and 50B selects any one of inductors L1 to L4 in the Y electrode unit driving cell 30 and the Z electrode unit driving cell 40 in accordance with a logical value of the switch control signal Cind.

Figure 9:
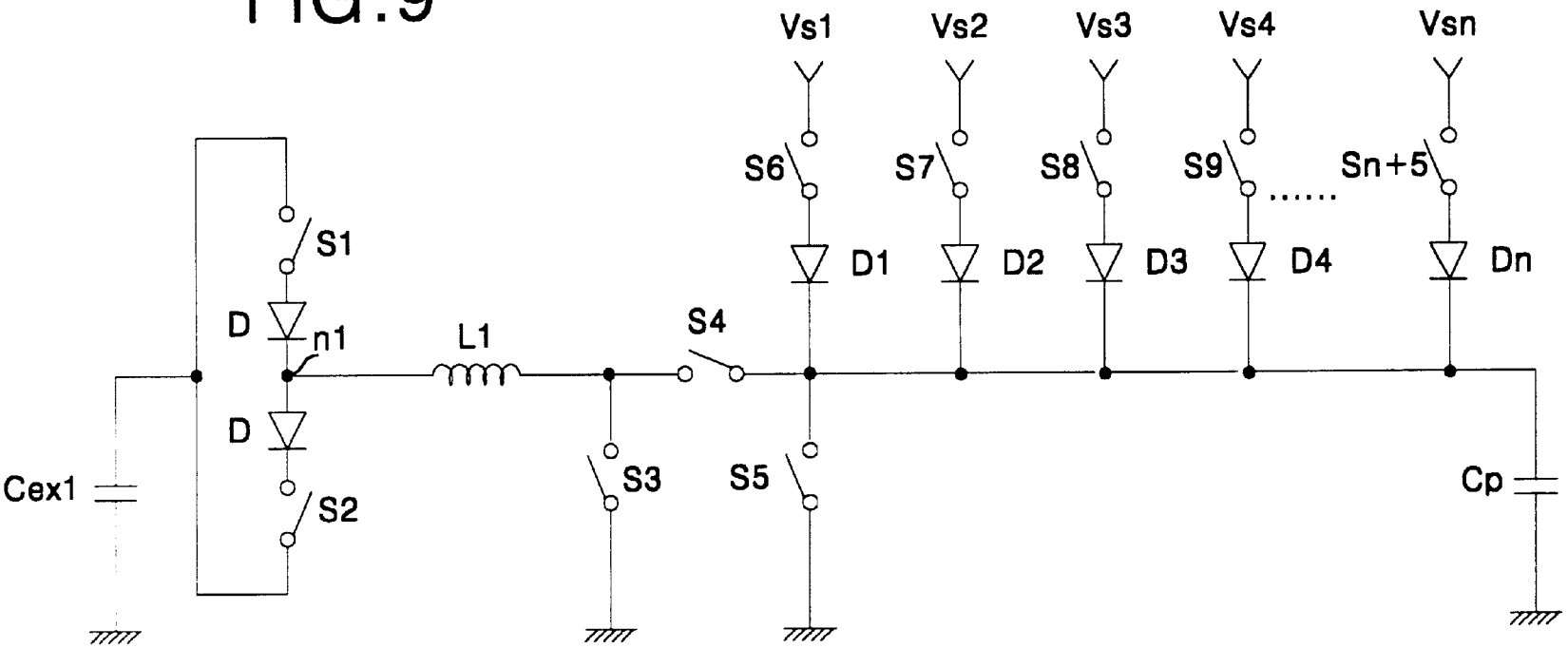
FIG. 9 is a circuit diagram of an energy recovering apparatus of multi-step type according to a fifth embodiment of the present invention.

Referring now to FIG. 9, there is shown an energy recovering apparatus according to another embodiment of the present invention for charging and discharging a panel capacitor Cp into more than n steps. The multi-step type energy recovering apparatus includes n sustaining voltage sources Vs1 to Vsn, and n switches S6 to Sn+5 for connecting each of the n sustaining voltage sources Vs1 to Vsn after an electric charge charged in an inductor L1 was applied to the panel capacitor Cp. The n switches S6 to Sn+5 are connected to the panel capacitor Cp in parallel. In comparison to the energy recovering apparatus shown in FIG. 5, the energy recovering apparatus shown in FIG. 9 is identical to the energy recovering apparatus in FIG. 5 until a process of charging the three-step sustaining voltage. Further, a process of charging the panel capacitor Cp into more than four steps also applies an external sustaining voltage stepwise after applying an electric charge charged in the inductor L1 to the panel capacitor Cp. Such an energy recovering apparatus can produce a sustaining pulse with more than n steps using a single unit driving cell.

Figure 10:
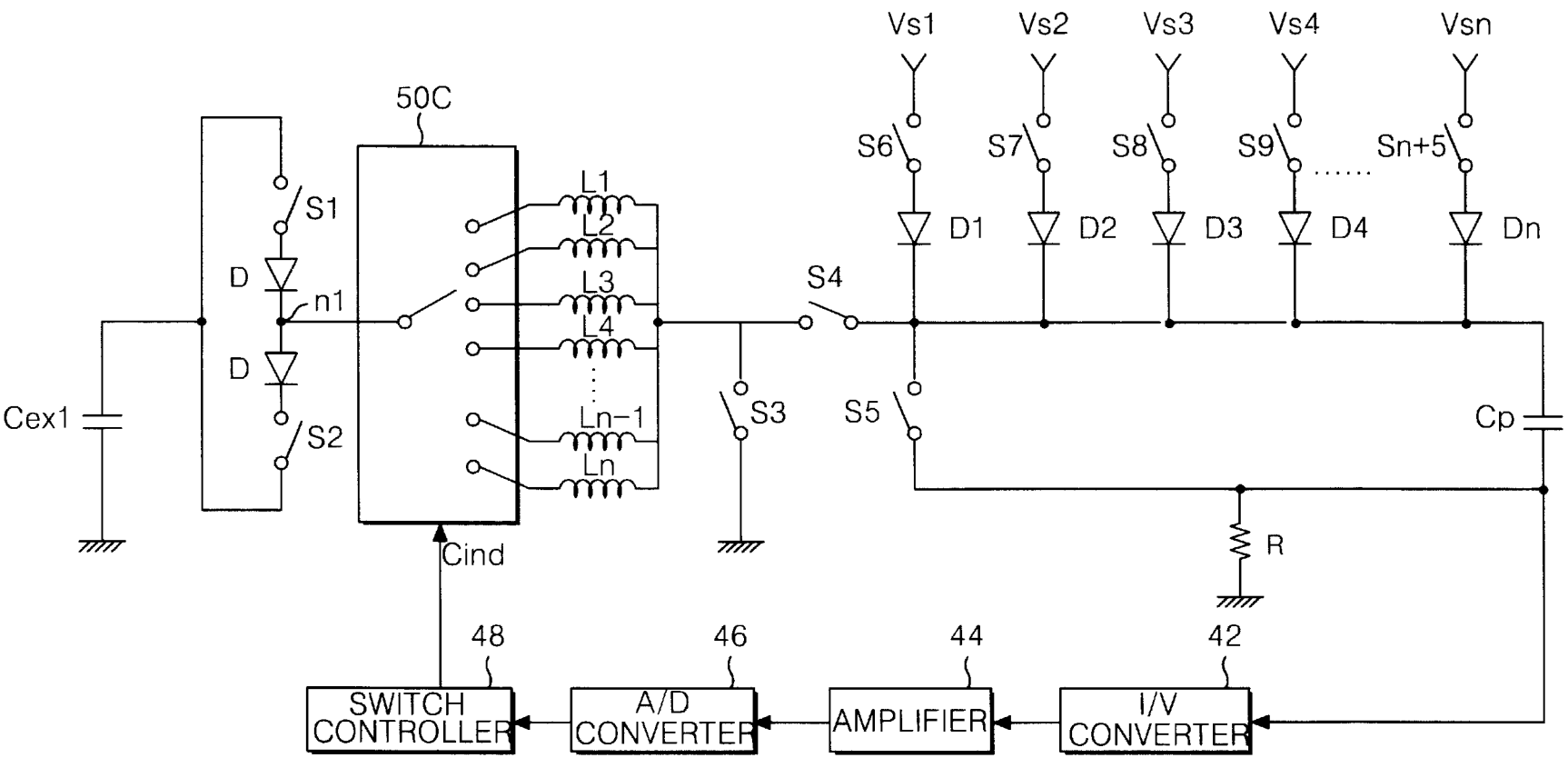
FIG. 10 is a circuit diagram of an energy recovering apparatus of multi-step type according to a sixth embodiment of the present invention.

FIG. 10 shows an embodiment to which a plurality of inductors and a switching part for controlling an inductance value in accordance with a panel load in the energy recovering apparatus in FIG. 9 are applied. Referring to FIG. 10, the multi-step type energy recovering apparatus includes a resistor R connected between the panel capacitor Cp and the ground terminal GND, first to nth inductors L1 to Ln having a different inductance value from each other, a switch part 50*c* for selecting any one of the inductors L1 to Ln, an I/V converter 42, an amplifier 44, an A/D converter 46 and a switch controller 48 that are connected between the resistor R and the switching part 50, and n switches S6 to Sn+5 for switching each of the first to nth sustaining voltages Vs1 to Vsn. The resistor R, the I/V converter 42, the amplifier 44, the A/D converter 46, the switch controller 48 and the switching part 50*c* detects a panel load to apply a switch control signal Cind to the switching part 50*c*. If a low panel brightness is detected, then an inductor having a small inductance value in the n inductors L1 to Ln is selected. Otherwise, if a high panel brightness is detected, then an inductor having a large inductance value is selected. As an inductance value of the inductor L is adjusted in accordance with the panel load, the sustaining voltages Vs1 to Vsn can be always synchronized with a peak value of an inductor current during a change in the panel load to thereby be applied to the panel capacitor Cp.

As described above, the multi-step type energy recovering apparatus and method according to the present invention supplies the panel with a high level current in advance using an electric charge charged in the inductor before an external voltage is applied, thereby reducing a power consumed during the sustaining discharge. Also, it can improve its efficiency and the brightness in comparison to the prior art having charged the panel using capacitors. Furthermore, the multi-step type energy recovering apparatus and method according to the present invention can produce a multi-step driving waveform using a single driving circuit, so that it is adaptive for producing a multi-step driving waveform and simplifies a configuration of the driving circuit. Moreover, the multi-step type energy recovering apparatus senses a panel load and adjust an inductance value of the inductor in accordance with the sensed panel load to synchronize an applied time of the sustaining voltage with a peak value of the inductor current, so that it can maintain a minimized power consumption independently of a change in the panel load.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An energy recovering apparatus of multi-step types comprising:

an inductor for supplying a display panel with a current;

an external voltage source for applying an external voltage to the display panel;

a first switching device for switching a current path between the display panel and the inductor in such a manner that the current charged in the inductor is supplied to the display panel before the external voltage is applied to the display panel;

a capacitor for coupling the inductor with an electric charge;

second and third switching devices connected to the capacitor and the inductor in parallel to switch a charge and discharge path of the capacitor; and a fourth switching device for switching a current path between the inductor and a ground source.

2. The energy recovering apparatus as claimed in claim 1, further comprising:

first and second sustaining electrodes formed in the display panel to cause a sustaining discharge;

at least one of first unit driving cell for applying a first driving pulse to the first sustaining electrode, said unit driving cell including the inductor, the capacitor, the external voltage source and the switching devices; and at least one of second unit driving cell for applying a second driving pulse to the second sustaining electrode, said unit driving cell including the inductor, the capacitor, the external voltage source and the switching devices.

3. The energy recovering apparatus of multi-step type of claim 1, further comprising:

first and second sustaining electrodes formed in the display panel to cause a sustaining discharge;

at least one of first unit driving cell for applying a first driving pulse to the first sustaining electrode, said unit driving cell including the inductor, n external voltage sources corresponding to n steps (wherein n is an integer) and the first switching device; and at least one of second unit driving cell for applying a second driving pulse to the second sustaining electrode, said unit driving cell including the inductor, n external voltage sources corresponding to n steps (wherein n is an integer) and the first switching device.

4. The energy recovering apparatus of multi-step type of claim 3, further comprising:

n switching devices (wherein n is an integer) connected between any one of the first and second sustaining electrodes and the external voltage source to switch an external voltage supply line.

5. An energy recovering apparatus of multi-step type, comprising:

a current charging device for supplying a display panel with a current;

an external voltage source for applying an external voltage to the display panel;

switch means for switching a current path between the display panel and the current charging device in such a manner that a current charged in the current charging device is supplied to the display panel before the external voltage is applied to the display panel;

first and second sustaining electrodes formed in the display panel to cause a sustaining discharge;

at least one of first unit driving cell for applying a first driving pulse to the first sustaining electrode, said unit driving cell including the current charging device, n external voltage sources corresponding to n steps (wherein n is an integer) and the switching means; and at least one of second unit driving cell for applying a second driving pulse to the second sustaining electrode, said unit driving cell including the current charging device, n external voltage sources corresponding to n steps (wherein n is an integer) and the switching means.

6. The energy recovering apparatus as claimed in claim 5, further comprising:

n switching devices(wherein n is an integer) connected between any one of the first and second sustaining electrodes and the external voltage source to switch an external voltage supply line.

7. An energy recovering apparatus of multi-step type, comprising:

at least two current charging devices for supplying a display panel with a current, said current charging devices having a number of inductors having an inductance value different from each other;

an external voltage source for applying an external voltage to the display panel; and switch means for selecting any one of the current charging devices in accordance with a panel load before the external voltage is applied to the display panel and for switching a current path between the display panel and the current charging device in such a manner that the current charged in the selected current charging device is supplied to the display panel.

8. The energy recovering apparatus as claimed in claim 7, wherein an inductor having a small inductance value in the current charging devices is charged when the display panel has a large load, whereas an inductor having a large inductance value in the current charging devices is charged when the display panel has a small load.

9. An energy recovering method of multi-step type, comprising:

providing a plurality of current charging devices for supplying a display panel with a current, wherein said current charging devices each include an inductor having an inductance value different from each other;

detecting a variable panel load in the display panel;

selecting one of the plurality of current charging devices in accordance with the detected panel load;

charging an electric charge into the selected current charging device;

supplying the display panel with the current charged in the selected current charging device to cause a sustaining discharge; and supplying an external voltage to the display panel to maintain the sustaining discharge.

10. The method of claim 9, further comprising:

forming first and second sustaining electrodes in the display panel to cause the sustaining discharge;

applying a first driving pulse to the first sustaining electrode using at least one of a first unit driving cell, said unit driving cell including the current charging devices, n external voltage sources corresponding to n steps (wherein n is an integer) and a switching device to switch between the selected current charging device and the external voltage according to the supplying steps; and applying a second driving pulse to the second sustaining electrode using at least one of a second unit driving cell, said unit driving cell including the current charging devices, n external voltage -sources corresponding to n steps (wherein n is an integer) and the switching device.

* * * * *